United States Patent [19]

Buhrer et al.

[11] Patent Number: 4,691,141

[45] Date of Patent: Sep. 1, 1987

[54] DOSING COMPOSITION FOR HIGH PRESSURE SODIUM LAMPS

[75] Inventors: Carl F. Buhrer; Alfred E. Feuersanger, both of Framingham, Mass.

[73] Assignee: GTE Laboratories Incorporated, Waltham, Mass.

[21] Appl. No.: 786,737

[22] Filed: Oct. 11, 1985

[51] Int. Cl.[4] ..... H01J 61/20

[52] U.S. Cl. ..... 313/565; 313/639; 313/642

[58] Field of Search ..... 313/565, 637, 638, 639, 313/564, 642; 252/181.1, 181.2, 181.3, 181.4, 181.6, 181.7

[56] References Cited

U.S. PATENT DOCUMENTS

| | | | |
|---|---|---|---|
| 3,318,649 | 10/1963 | Keller et al. . | |
| 3,384,798 | 5/1968 | Schmidt | 313/639 X |
| 3,657,589 | 4/1972 | Porta et al. . | |
| 3,733,194 | 5/1973 | Porta et al. . | |
| 3,926,832 | 12/1975 | Barosi . | |
| 4,107,565 | 8/1978 | Isojima et al. . | |

FOREIGN PATENT DOCUMENTS

| | | | |
|---|---|---|---|
| 255604 | 10/1969 | U.S.S.R. | 313/638 |

*Primary Examiner*—Palmer C. DeMeo
*Assistant Examiner*—K. Wieder
*Attorney, Agent, or Firm*—Ernest V. Linek

[57] ABSTRACT

The present invention relates to a dosing composition useful in high pressure sodium lamps. The invention relates specifically to new multicomponent alloy fills for HPS lamps and the design of such fills. The present invention provides an HPS lamp dosing composition that will supply the required amount of sodium and mercury for proper lamp operation, but which will have a lower vapor pressure during the sealing operation, such that mercury loss from the composition will be lower than that from the presently used sodium amalgam. In the present invention, either one of the compounds, $Ti_3Hg$ or $Zr_3Hg$, is mixed with an intermetallic compound of sodium that has a melting point above about 600° C., such that both the mercury and sodium metal are stabilized to avoid melting or vaporization at about 600° C. The preferred sodium compound is $Na_3Bi$, which melts at 755° C., although $Na_3Sb$ and $Na_2Te$ with higher melting points may be used. The dosing mixture for HPS lamps is preferably a mixture of $Ti_3Hg$ and $Na_3Bi$.

15 Claims, 3 Drawing Figures

DOSING COMPOSITION FOR HIGH PRESSURE SODIUM LAMPS

BACKGROUND OF THE INVENTION

High pressure sodium metal vapor (HPS) lamps are widely used today for outdoor lighting, because of their high luminous efficiency. Although they produce a pink-to-yellow light output, their low power consumption and long life make them particularly attractive for street lighting where lamps of 150 to 1000 W size are used. Recently high pressure sodium lamps in sizes as small as 35 W have been constructed so that this high efficiency lighting device can be used in a variety of applications where a lesser amount of light is needed. Such small HPS lamps can often replace incandescent lamps of 100 to 150 W size with considerable power savings.

The typical HPS lamp is contructed from a cylindrical tube of translucent polycrystalline alumina with tungsten electrodes sealed in at both ends. Within this arc tube is an electrical discharge in a mixture containing mercury, sodium vapor and a noble gas, usually xenon. Current is conducted to the electrodes via a feedthrough assembly, consisting of a niobium metal rod or tube sealed to the alumina arc tube, with a meltable frit composition based on calcium aluminate. Both the niobium and the frit are chosen to match in thermal expansion that of the alumina arc tube. The complete arc tube and electrode assembly is mounted within a glass outer envelope which is evacuated to high vacuum to avoid oxidation of the exposed metal parts that reach several hundred degrees Celsius when the lamp is operating normally. The metal (Nb) in the arc tube feedthrough oxidizes readily and, therefore, air or oxygen must be removed from the outer jacket. Usually it is evacuated to prevent metal oxidation, assist in maintaining a sufficiently high arc tube end temperature, and at the same time improve lamp efficacy by insulating the arc tube from the surroundings, thus reducing thermal conduction losses.

The arc tube is assembled by placing a first feedthrough and electrode assembly on top of a polycrystalline alumina tube with a preformed ring of frit composition in between, and heating in an atmosphere of at least 200 torr of argon, the top half of the tube from 1400° to 1500° C. The frit composition melts and the feedthrough assembly settles in place with the melted frit filling the space between it and the alumina tube. After cooling, the partial assembly is inverted, an amalgam pellet containing sodium and mercury is filled into the open end of the arc tube in a dry environment, and a second feedthrough and electrode assembly is placed on top with a second preformed ring of frit composition in between. The second seal is made by heating the top half of the tube from 1400° to 1500° C. in an atmosphere of xenon at about 20 torr pressure. When the frit melts and flows, the feedthrough assembly settles in place, trapping a predetermined amount of xenon and the amalgam pellet with the arc tube. After cooling the arc tube assembly is ready for mounting inside the outer glass lamp envelope.

When the above production procedure is applied to HPS lamps of low wattage rating, a problem arises because of the small sixe of the polycrystalline alumina arc tube. While making the second seal at about 1400° to 1500° C. at the top of the arc tube, the bottom end of the arc tube where the amalgam pellet is resting rises in temperature to about a few hundred degrees Centigrade, and the mercury begins to volatilize in the low xenon pressure environment. The mercury vapor displaces the xenon and often prevents the feedthrough and electrode assembly from settling in place as the frit melts.

Although the lower portion of the arc tube is supported in a conduction-cooled metallic heat sink while the upper portion is radiantly heated, the high temperature differential between the top end being sealed and the lower end with the amalgam is difficult to maintain when the arc tube length is as short as 3.8 cm (as with the 35 W design), or even shorter.

HPS lamps are usually filled with an excess of amalgam to compensate for Na loss during the life of the lamps (16,000 to 24,000 h) known to occur in a small degree by diffusion through the polycrystalline ceramic arc tube and mainly through defects of the polyphase ceramic sealing frit at the end of the arc tube, which is the cold spot and location of the excess sodium fill behind the electrodes (see, FIG. 1). Loss of sodium causes a shift in the equilibrium partial vapor pressure ratio of Na and Hg, which is a critical lamp design parameter, and has to be adjusted to maintain a sodium D-line peak separation of about 8.5 nm for optimum efficacy of the lamp.

The stabilization of mercury by compound formation and its subsequent release by dissociation has been described by Keller in U.S. Pat. No. 3,318,649, and by Della Porta, et al. in U.S. Pat. Nos. 3,657,589 and 3,733,194, which are all incorporated herein by reference. In each case, an intermetallic compound is formed between a highly electropositive metal and the weakly electropositive element mercury and subsequently dissociated to release the mercury. The most satisfactory compounds would appear to be $Ti_3Hg$ and $Zr_3Hg$ which, according to the latter patents, resist dissociation up to about 550° C. and are recommended for uses in dosing fluorescent lamps.

SUMMARY OF THE INVENTION

The present invention relates to a dosing composition useful in high pressure sodium lamps. This type of lamp is the most efficient lamp with a reasonable color rendering index (CRI) for color distinction and shows the largest growth in production. The invention relates specifically to new multicomponent alloy fills for HPS lamps and the design of such fills.

The present invention provides an HPS lamp dosing compostion that will supply the required amount of sodium and mercury for proper lamp operation, but which will have a lower vapor pressure during the sealing operation, such that mercury loss from the composition will be lower then that from the presently used sodium amalgam.

Most preferably, this invention provides a stoichiometric mixture of two reactive solids, neither of which will melt, dissociate or decompose below 600° C., but which upon reaction at some higher temperature, normally encountered in the lamp, will release both the mercury and sodium required for proper HPS lamp operation, leaving a residue that otherwise remains inert within the operating HPS lamp.

In preferred embodiments of the present invention, either of the compounds $Ti_3Hg$ or $Zr_3Hg$, is mixed with a stoichiometric amount of an intermetallic compound of sodium that has a melting point above about 600° C., such that both the mercury and sodium metal are stabilized to avoid melting or vaporization at about 600° C. The preferred sodium compound is $Na_3Bi$, which melts at 755° C., although $Na_3Sb$ and $Na_2Te$ with higher melting points may also be used.

The most preferred dosing mixture for HPS lamps is a stoichiometric mixture of $Ti_3Hg$ and $Na_3Bi$, which while not wishing to be bound by theory, is believed to react in the sealed lamp according to the equation:

$$Ti_3Hg + Na_3Bi \rightarrow Ti_3Bi + 3Na + Hg$$

Moreover, the present invention achieves the tie-up of excess sodium by bismuth in the excess fill condensate, reducing its activity in the high temperature arc tube environment. The compound of Na-Bi reduces the exposure to free sodium of the surroundings of the fill condensate (see FIG. 1), particularly the exposed frit which is conducive to the Na diffusion at high temperatures of 700° C. or higher.

DETAILED DESCRIPTION OF THE INVENTION

Figure 1:
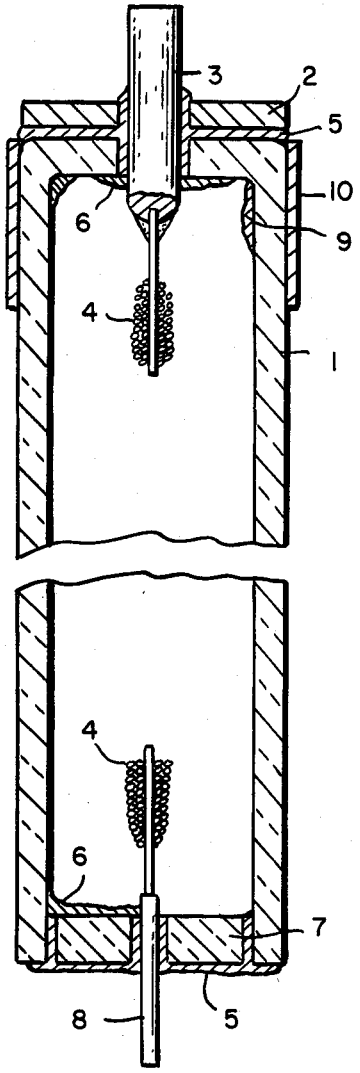
FIG. 1 is a longitudinal view of a lamp arc tube useful in accord with the present invention.

An axial section of an arc tube is shown in FIG. 1, embodying the invention and comprising an envelope of ceramic tubing consisting of sintered high density polycrystalline alumina (PCA). The alumina ceramic is not clear like quartz, but has a very high light transmittance of 95% or better that is very suitable as a plasma discharge vessel. The central portion of the arc tube has been cut to show the relevant parts of the tube. The end sections shown are two types of commonly used metal-ceramic end closures called the monolithic-(upper) and wire-seal (lower). PCA arc tube 1 is hermetically sealed by means of the Nb feedthrough 3 and the sealing washer 2, or an Nb wire 8 with PCA washer 7, using the high temperature calcium aluminate-based sealing frit 5. The thermionic electrodes 4 are tungsten impregnated with an oxide emissive coating. The arc tube fill, after it has been dispensed during initial lamp operation, is located at the cold spots 9 at the end of the arc tube, and from there a condensate layer 6, which is shown exaggerated in volume. Heat shields 10 are used to increase the cold spot temperature and partial pressures of the fill components.

Figure 2:
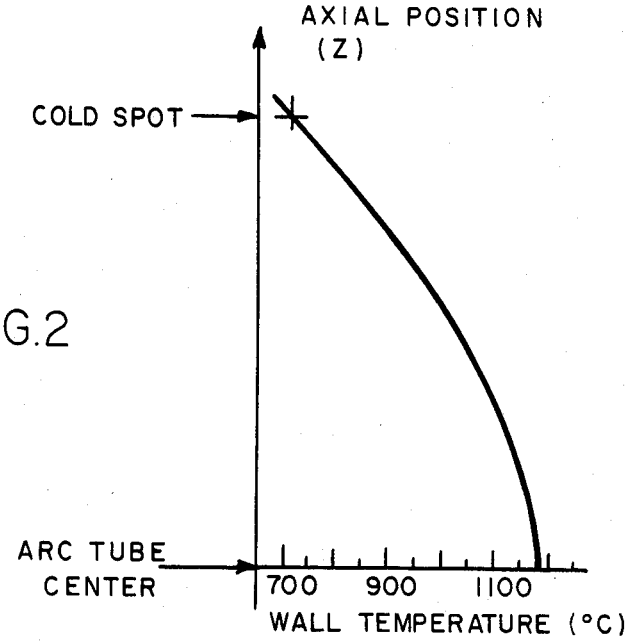
FIG. 2 is a graphic illustration of the temperature along the axial arc tube wall of an HPS lamp operating at equilibrium and optimum power.
Figure 3:
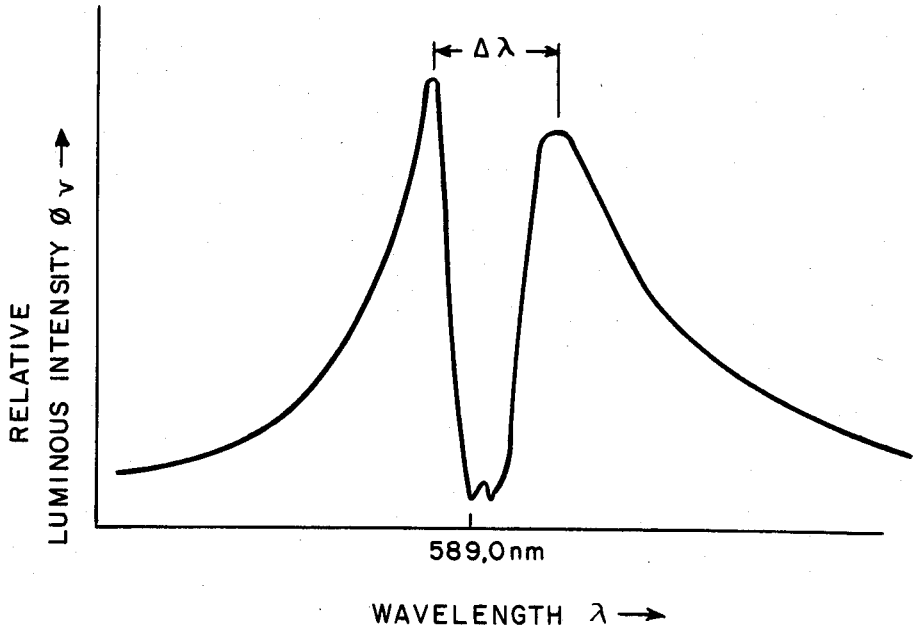
FIG. 3 is a graphic illustration of luminous intensity vs. wavelength for a high pressure sodium discharge lamp, showing the shape and difference in wavelength between the maxima of a self-reversed resonance line.

The wall temperature along the arc tube wall in axial direction is shown in FIG. 2 for an HPS lamp operating in equilibrium at rated power. The cold spot or temperature at the end of the arc tube is in the range of 680° to 720° C. for regular HPS lamps and 800° C. for lamps with high color rendering index. This temperature determines the partial vapor pressures of the fill components which are related and are derived from the shape and difference in wavelength between the two maxima of a self-reversed sodium resonance line (see FIG. 3).

For optimum light output the separation of the self-reversed sodium D-lines is bout 8.5 nm. The gas pressures in the operating lamp are for Na, 60 to 150 torr (8 to 20 kPa), with an optimum value of 105 torr; for Hg, 400 to 800 torr (53 to 106 kPa); and for Xe, about 20 Torr (2.67 kPa). The buffer gas Xe, with increasing pressure, increased the thermal isolation of the arc discharge from the arc tube wall, improves the spectral light intensity distribution of the lamp and its luminous efficacy. However, it also contributes to higher ignition voltages for the discharge and is, therefore, usually limited to $<100$ torr (13.3 kPa).

While the preferred composition of the present invention comprises a stoichiometric admixture of an intermetallic compound of sodium and an intermetallic compound of mercury, other i.e., non-stoichiometric combinations are within the scope of this invention, so long as the dissociation point of the combination is greater than about 600° C.

The present invention will be further illustrated with reference to the following examples which are intended to aid in the understanding of the present invention, but which are not to be construed as limitations thereof. All percentages reported herein, unless otherwise specified, are percent by weight (w/o). All temperatures are expressed in degrees Celsius. The examples are directed to lamps fabricated with Na, Hg, Bi, and Ti fills.

EXAMPLE 1

HPS lamps with 150 W/100 V $Al_2O_3$ arc tubes were prepared using a fill comprising 30 mg of 75 w/o Hg-25 w/o Na, 39 mg $Ti_3Bi$, and 20 torr of argon. These lamps were prepared to study the operation of the 150 W lamps when titanium bismuth, the residue from the proposed mixture, is present in the fill. Starting and operating of the lamps was nominal compared with a lamp without the dosing residue. Operating with 4 mm heat shields on the arc tube, the lamp voltage was 99.1 V, the lamp current was 1.85 A, and the D-lines separation was 6.8 nm.

EXAMPLE 2

Dosing in HPS arc tubes was performed by using mixtures of intermetallic compounds $Ti_3Hg$ and $Na_3Bi$ to obtain the required Hg and Na quantities to sustain a predominantly Na plasma in the arc tube, as described above. The mixture was pressed into pellets in a dry box ($H_2O$ $<1$ ppm) to facilitate the filling of the arc tubes before forming the second seal and to place the fill behind the electrodes and avoid fill evaporation onto the arc tube wall during lamp initiation and dosing that can lead to undesirable end blackening. Thermal decomposition of the pellets and consequent release of sodium and mercury was achieved by operation of the arc tube at power levels ranging from design power to 50% overpower, or be preheating the completed arc tube within a quartz vacuum enclosure at temperatures from 800° to 1000° C.

The procedure for dispensing the fill component by operating the arc tube at rated power over a dosing period of about 25 h was the preferable technique. Regular lamps were filled with an excess of amalgam to compensate for sodium loss during the life of the lamp. A typical fill of 75 w/o Hg-25 w/o Na comprises a weight of 30 mg containing 22.5 mercury and 7.5 mg sodium. A mixture of 30.5 mg of $Na_3Bi$ and 38.1 mg of $Ti_3Hg$ in a weight ratio of $Na_3Bi/Ti_3Hg$ of 0.8 was used because as shown in the equation for the dosing reaction (supra) this reacts to give a nominal fill composition containing 22.2 mg mercury and 7.6 mg sodium.

EXAMPLE 3

Additional sodium with its vapor pressure limited by its alloying with bismuth may be added by increasing the weight ratio of $Na_3Bi/Ti_3Hg$ from 0.8 to 1.6 thereby permitting lower arc voltages and increased D-line spacing during lamp operation. This approach was particularly useful in achieving the proper arc voltage drop and luminous output of a 150 watt HPS lamp.

What is claimed is:

1. A dosing composition for high pressure sodium vapor lamps comprising an admixture of an intermetallic compound of sodium having a melting point in excess of about 600° C. and an intermetallic compound of mercury having a dissociation point of greater than about 600° C., which admisture will react and release sufficient mercury and sodium for the operation of said lamps via the thermal decomposition of the admixture.

2. The dosing composition of claim 1 wherein the intermetallic compound of sodium is selected from the group of $Na_3Bi$, $Na_3Sb$, and $Na_2Te$.

3. The dosing composition of claim 2, wherein the intermetallic compound of sodium is $Na_3Bi$.

4. The dosing composition of claim 1, wherein the intermetallic compound of mercury is selected from compounds having the formula:

$$Zr_xTi_yHg_z$$

wherein x and y have any value of from 0 to 13, with the proviso that the sum of x+y is a value of from 3 to 13, and z is 1 or 2.

5. The dosing composition of claim 4, wherein the intermetallic compound of mercury is selected from the group of $Ti_3Hg$ and $Zr_3Hg$.

6. A dosing composition for high pressure sodium vapor lamps comprising a stoichiometric admixture of $Ti_3Hg$ and $Na_3Bi$.

7. A high pressure sodium metal vapor lamp comprising in combination:

(a) a cylindrical arc tube of translucent polycrystalline alumina having two sealed ends, each being provided with tungsten electrodes;

(b) an electric discharge mixture comprising a noble gas and an admixture of an intermetallic compound of mercury having a dissociation point of greater than about 600° C. and an intermetallic compound of sodium having a melting point in excess of about 600° C., said admixture being retained within the space defined by the cylindrical arc tube, and said admixture providing sufficient mercury and sodium for the operation of said lamp via its thermal decomposition;

(c) an electric current feedthrough assembly comprising a niobium metal rod sealed to each end of the alumina arc tube, said feedthrough assembly comprising a meltable frit; and (d) an evacuated outer glass envelope surrounding the outer periphery of the cylindrical arc tube.

8. The high pressure sodium metal vapor lamp of claim 7, wherein the intermetallic compound of sodium is selected from the group of $Na_3Bi$, $Na_3Sb$, and $Na_2Te$.

9. The high pressure sodium metal vapor lamp of claim 8, wherein the intermetallic compound of sodium is $Na_3Bi$.

10. The high pressure sodium metal vapor lamp of claim 7, wherein the intermetallic compound of mercury is an alloy of mercury and a metal selected from Groups IA, IIA, and III of the Periodic Table of the Elements.

11. The high pressure sodium metal vapor lamp of claim 7, wherein the intermetallic compound of mercury is selected from compounds having the formula:

$$Zr_xTi_yHg_z$$

wherein x and y have any value of from 0 to 13, with the proviso that the sum of x+y is a value of from 3 to 13, and z is 1 or 2.

12. The high pressure sodium metal vapor lamp of claim 11, wherein the intermetallic compound of mercury is selected from the group of $Ti_3Hg$ and $Zr_3Hg$.

13. The high pressure sodium metal vapor lamp of claim 7, wherein the electrical discharge mixture is a stoichiometric admixture of $Ti_3Hg$ and $Na_3Bi$.

14. A method of operating a high pressure sodium metal vapor lamp as an unsaturated high pressure sodium metal vapor lamp, said method comprising reducing the diffusion activity of sodium through the sealing frit employed in a high pressure sodium metal vapor lamp by alloying the sodium with bismuth, thereby reducing the activity thereof at the operating temperatures of the lamp.

15. The dosing composition of claim 1, wherein the intermetallic compound of mercury is an alloy of mercury and a metal selected from Groups IA, IIA, and III of the Periodic Table of the Elements.

* * * * *